United States Patent [19]

Kobayashi et al.

[11] Patent Number: 4,497,144

[45] Date of Patent: Feb. 5, 1985

[54] METHOD FOR MANUFACTURING QUADRIC SURFACE

[75] Inventors: Hiroshi Kobayashi, Kodaira; Haruhiko Machida, Tokyo, both of Japan

[73] Assignee: Machida Endoscope Company Limited, Tokyo, Japan

[21] Appl. No.: 625,192

[22] Filed: Jun. 28, 1982

Related U.S. Application Data

[63] Continuation of Ser. No. 276,737, Jun. 24, 1981, abandoned.

[30] Foreign Application Priority Data

Jun. 26, 1980 [JP] Japan ..... 55-86964
Feb. 2, 1981 [JP] Japan ..... 56-14691

[51] Int. Cl.[3] ..... B24B 1/00; B24B 13/00

[52] U.S. Cl. ..... 51/284 R; 51/58; 82/12; 264/2.5; 264/2.7

[58] Field of Search ..... 51/33 R, 33 W, 47, 55, 51/57, 58, 60, 67, 68, 69, 106 LG, 105 LG, 124 L, 284 R; 82/12; 264/2.5, 2.7

[56] References Cited

U.S. PATENT DOCUMENTS

| | | | |
|---|---|---|---|
| 1,325,789 | 12/1919 | Johnsson | 51/33 W |
| 2,467,070 | 4/1949 | Zukas | 82/12 |
| 2,558,771 | 7/1951 | Middaugh et al. | 82/12 X |
| 2,568,040 | 9/1951 | Touvay | 51/58 |
| 2,589,488 | 3/1952 | Fowler | 51/124 L |
| 2,716,913 | 9/1955 | Leerkamp | 82/12 |
| 3,977,279 | 8/1976 | Hooker | 51/124 L X |
| 4,068,413 | 1/1978 | Suddarth | 51/124 L X |

*Primary Examiner*—Robert P. Olszewski
*Attorney, Agent, or Firm*—Lawrence I. Field

[57] ABSTRACT

A working tool having a linear working edge is secured to a tool holding arm which is rotatably arranged about a focus shaft extending in parallel with a Z axis and is slidable linearly in parallel with an XY plane. A workpiece is secured to a workpiece mounting member in such a manner that its center axis extends in an X′ direction which is inclined by an angle $(\pi/2-\theta)$ with respect to an X axis. A longitudinal direction of the working edge is inclined by the angle $\theta$ with respect to a line which is obtained by projecting a sliding direction of the tool holding arm. When the working tool and the workpiece are moved relative to each other, the workpiece is cut into a quadric surface in accordance with a quadric surface formed by the working edge as an envelope of tangents.

15 Claims, 26 Drawing Figures

METHOD FOR MANUFACTURING QUADRIC SURFACE

This application is a continuation of application Ser. No. 276,737, filed June 24, 1981.

BACKGROUND OF THE INVENTION

The present invention relates to a method for manufacturing aspherical surfaces, particularly quadric surfaces such as elliptic, parabolic and hyperbolic surfaces.

Nowadays, spherical lenses and spherical reflecting mirrors have been widely used for optical systems, because they are easily available. However, if aspherical surfaces such as elliptic, hyperbolic and parabolic surfaces could be manufactured in a simple and accurate manner, they may be advantageously used in various optical systems. For instance, aspherical lenses and aspherical reflecting mirrors have been often used in order to eliminate or decrease aberrations. However, in practice, it is extremely difficult to manufacture the aspherical surfaces. It is a well known fact that it took several years to grind an aspherical reflecting mirror of a large diameter for use in an astronomical observatory. In this manner, at present, it is technically as well as economically difficult to utilize the aspherical optical systems to the full extent and thus, in the optical systems such as camera lens systems, various aberrations have to be corrected by combining a plurality of spherical lenses. This results in that the lens systems are liable to be complicated in construction, heavy in weight and large in size.

Heretofore, known methods for manufacturing the aspherical surfaces may be roughly classified into the following three methods.

(a) copy-grinding on the basis of a master curve (b) press-molding of synthetic resin or glass material (c) cutting under numerical control with using NC machine tools.

In the methods (a) and (b) use is made of a master which has to be manufactured by skilled workers almost in a manual manner. Moreover an accuracy of the master can not be made sufficiently high. Further in the method (c) using the NC machine tools, since a digital control is applied, a cut surface is inherently subjected to steps or stripes. This is particularly noticeable with a surface of large radius of curvature. In order to reduce such a drawback there has been developed an R interpolation method, but this solution could not assure the accuracy sufficiently. As described above, accurate aspherical surfaces could not be manufactured by the known methods and there has not been proposed any method for easily manufacturing aspherical surfaces having the required high accuracy.

SUMMARY OF THE INVENTION

The present invention has for its object to provide a novel and useful method for manufacturing easily and accurately aspherical surfaces having theoretically determined configuration.

It is another object of the invention to provide a method for manufacturing aspherical surfaces in which dimensions of aspherical surfaces can be changed by simply tilting a working tool.

According to the invention a method for manufacturing a quadric surface comprises;

securing a working tool having a linear working edge to a tool holding arm which is rotatable about a focus shaft extending in an X, Z plane passing through an origin of rectangular coordinates of X, Y and Z axes and being in parallel with the Z axis, and is slidable linearly in parallel with an X Y plane, said working tool being arranged in such a manner that its working edge is faced against an axial line of said focus shaft and lies in the X Y plane and that a longitudinal direction of the working edge makes an angle $\theta$ with respect to a line which is obtained by projecting a sliding direction of said tool holding arm onto the X Y plane;

moving a cross point between the working edge and said projected line along a predetermined path;

securing a workpiece to a workpiece mounting member in such a manner that a center axis of the workpiece lies in an X'Z plane formed by the Z axis and an X' axis which is obtained by rotating the X axis by an angle $(\pi/2-\theta)$ about the focus shaft; and moving the working tool and the workpiece relative to each other to form the workpiece into a quadric surface in accordance with a quadric surface formed by said working edge as an envelope of tangents.

The present invention also relates to an apparatus for manufacturing aspherical surfaces such as elliptic, hyperbolic and parabolic surfaces.

According to the invention an apparatus for manufacturing a quadric surface comprises;

a bed;

a working tool having a linear working edge;

a working tool mounting member for securing the working tool;

a focus shaft situating in an X Z plane passing through an origin of rectangular co-ordinates of X, Y and Z axes and extending in parallel with the Z axis, for supporting the working tool mounting member in a rotatable and slidable manner in parallel with an X Y plane, said working tool being secured to the working tool mounting member in such a manner that its working edge is faced against an axial line of said focus shaft and lies in the X Y plane and that a longitudinal direction of the working edge makes an angle $\theta$ with respect to a line which is obtained by projecting a sliding direction of said working tool mounting member onto the X Y plane;

means for moving the working tool mounting member in such a manner that a cross point between the working edge and said projected line is moved along a predetermined path;

a workpiece mounting member for securing a workpiece in such a manner that a center axis of the workpiece lies in an X' Z plane formed by the Z axis and an X' axis which is obtained by rotating the X axis by an angle $(\pi/2-\theta)$ about the focus shaft; and means for moving the workpiece mounting member relative to the working tool mounting member.

DESCRIPTION OF THE PREFERRED EMBODIMENTS

Figure 1A:
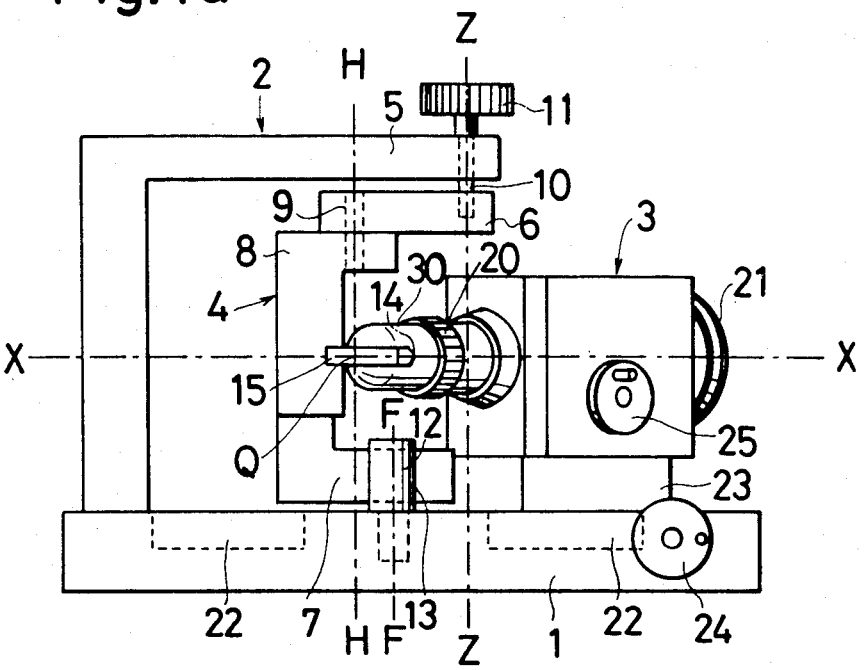
FIGS. 1*a* and 1*b* are side and plan views, respectively showing a cutting machine according to the invention for forming an ellipsoidal surface of revolution.
Figure 1B:
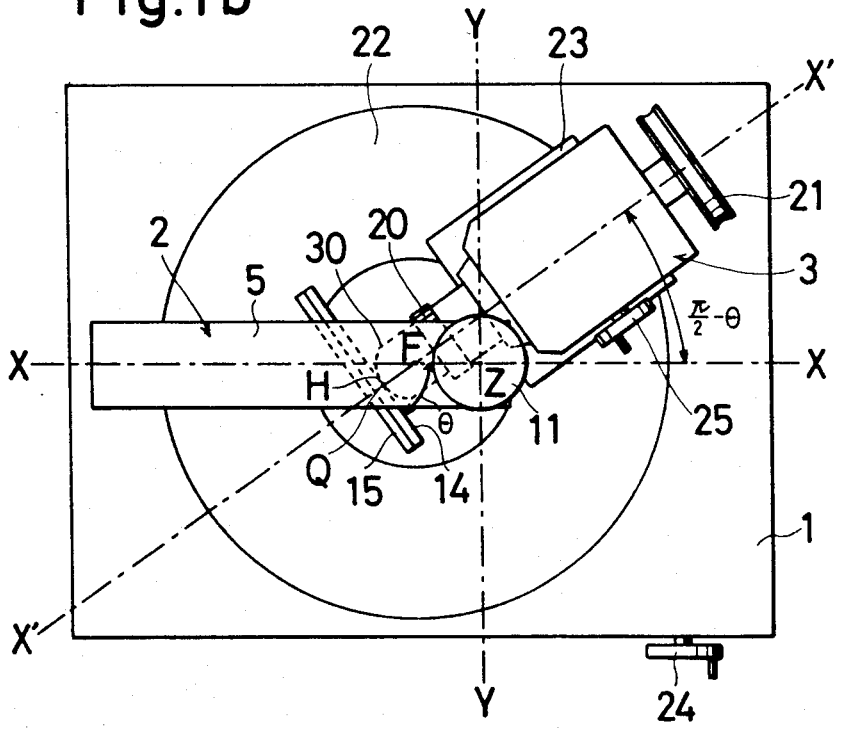
Figure 2:
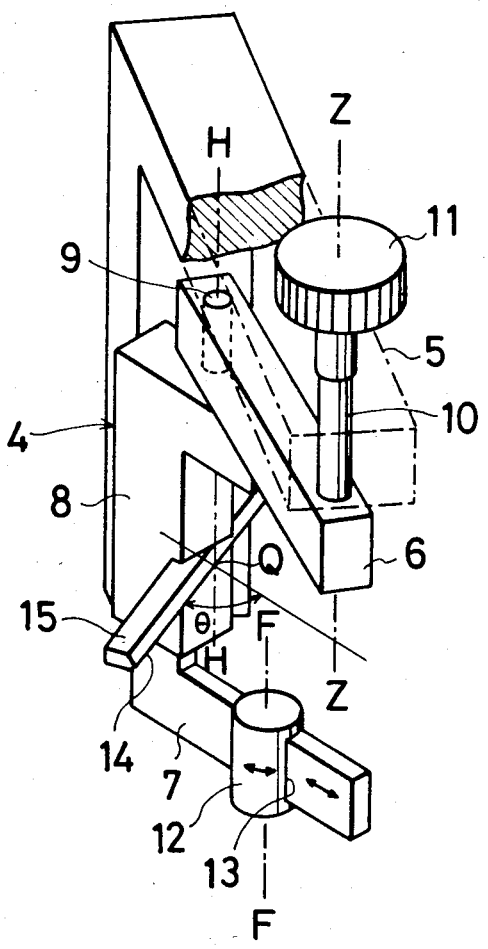
FIG. 2 is an enlarged perspective view showing a main part thereof.

FIGS. 1*a* and 1*b* show an embodiment of an apparatus for carrying out the method according to the invention. The cutting machine of this embodiment is to form an ellipsoidal surface of revolution. FIG. 2 is a perspective view illustrating a main part thereof. On a bed 1 disposed in parallel with an X Y plane are arranged a tool mounting member 2 and a workpiece mounting member 3. The tool mounting member 2 comprises a supporting frame 5 which supports a tool holding arm 4 together with a bed 1. The holding arm 4 supported by the bed 1 and the supporting frame 5 has a substantially U-shaped side elevational configuration including an upper arm 6, a middle portion 8 and a lower arm 7. The upper arm 6 is journalled to the supporting frame 5 and the lower arm 7 is journalled to the bed 1 by means of a special shaft 12 (hereinafter referred to as a focus shaft). The upper arm 6 and middle portion 8 of the tool holding arm 4 are formed as separate bodies and are coupled with each other in a pivotable manner by a connecting rod 9 aligned with an axis H—H extending in parallel to a Z-axis. Through the supporting frame 5 is passed an operating shaft 10 extending coaxially with the Z-axis and a lower end of the shaft 10 is fixed to the upper arm 6 of the tool holding arm 4. A rotating knob 11 is secured to an upper end of the shaft 10. The focus shaft 12 is journalled to the bed 1 about an axis F—F extending in parallel with the Z axis and passing through a point on a negative side of the X axis. The lower arm 7 of the tool supporting arm 4 is slidably connected to the shaft 12 in parallel with the X-Y plane. For instance, the shaft 12 has formed therein a guide hole 13 extending in parallel with the X Y plane and the lower arm 7 is slidably inserted into the hole 13. To the middle portion 8 of the tool holding arm 4 is secured a grinding or cutting tool 15 having a linear cutting edge 14 which extends in the X Y plane. The cutting edge 14 is faced against the Z-axis as well as the F—F axis. In this case, the working edge 14 is so arranged that a line formed by projecting the lower arm 7 onto the X Y plane and the working edge 14 make an angle $\theta$ with an apex at a point Q on the working edge 14. Therefore, this point Q is situated on the H—H axis.

The workpiece mounting member 3 comprises a chuck 20 for holding a workpiece 30 to be cut or ground. In order to rotate the workpiece 30 about an axis X', the chuck 20 is connected to a pulley 21 which is rotated by a motor (not shown) by means of a belt (also not shown). The axis X' of the workpiece mounting member 3 is situated on the X Y plane and is inclined with respect to the X axis by an angle of $(\pi/2-\theta)$ in accordance with the above mentioned angle about the F—F axis. In order to adjust said angle $(\pi/2-\theta)$ at will, the workpiece mounting member 3 is provided on a rotating table 23 which is coupled with a rotating plate 22 which is rotatably provided on the bed 1 about the F—F axis by means of a handle 24. By suitably operating the handle 24, the X' axis can be inclined on the X Y plane with respect to the X axis by the angle of $(\pi/2-\theta)$. Further it should be noted that the X' axis always passes through the F—F axis. Further the workpiece mounting member 3 is slidably mounted on the rotating table 23 in the direction of X' axis by means of a handle 25.

For instance, when the workpiece 30 such as a short rod of transparent glass or acrylate resin is to be cut into a lens having an ellipsoidal surface of revolution, the workpiece 30 is at first secured to the chuck 20. While the workpiece 30 is rotated by the motor by means of the pulley 21, the workpiece 30 is fed toward the tool mounting member 2 by operating the handle 25. Then the knob 11 of the shaft 10 is rotated to move the working edge 14 of the cutting tool 15 held by the arm 4 along a given desired path by means of the upper arm 6 and connecting rod 9. The linear working edge 14 forms tangents with respect to an ellipsoid on the X Y plane passing the origin O as explained later. That is to say, by moving the arm 4 continuously, the working edge 14 moves along the ellipsoid. Therefore, by moving gradually the workpiece 30 toward the tool 15, its front end is cut in an ellipsoidal surface of revolution as illustrated by broken line in FIG. 1*b*. When the tool holding arm 4 is swung about the Z axis by means of the operating shaft 10, while the lower arm 7 of tool holding arm 4 is rotatably and slidably supported by the focus shaft 12, the point Q on the working edge 14 moves along a circle on the X Y plane having a center at the origin O of the X-Y co-ordinates. A position of the focus shaft 12 projected on the X Y plane, i.e. the F—F axis situates at a focus point of the ellipsoidal surface of revolution to be cut.

Now the principle of the present invention will be explained in detail. At first, an apparatus shown in FIGS. 3*a*, 3*b* and 3*c* will be considered. In this apparatus, the direction of the working edge 14 of cutting tool 15 is made perpendicular to a segment connecting horizontally the point Q on the working edge 14 and the F—F axis and thus, the X axis is made coincident with the X' axis, i.e. $\theta=\pi/2$. As shown in FIG. 4, a tangent line T is drawn at an arbitrary point p on an ellipse A. Then a perpendicular S is drawn to the tangent T from a focus f of the ellipse A. A cross point q between the tangent T and perpendicular S is always on an auxiliary circle B having a diameter equal to a major axis of the ellipse A. This will be proved in the following manner. The ellipse A of FIG. 4 may be expressed by the following equation (1).

$$x^2/a^2+y^2/b^2=1 \quad (1)$$

wherein, a is a major axis and b is a minor axis of the ellipse. The tangent T passing through the point $p(x_1, y_1)$ on the ellipse A is a line passing the point $p(x_1,y_1)$ and having a gradient $m=-(b^2x_1)/(a^2y_1)$ and thus, can be expressed by the following equation (2).

$$y-y_1=m(x-x_1) \quad (2)$$

Further the focus f of ellipse A is spaced from a center O by a distance of ae, wherein e is an ellipticity and represented by $e=\sqrt{a^2-b^2}/a$. Therefore, the perpendicular S which intersects with the tangent T and passes through the focus f can be represented by the following equation (3).

$$y=-(1/m)\cdot(x-a\cdot e) \quad (3)$$

The above equation (2) may be rewritten into the following equation.

$$y = mx + (b^2x_1^2)/(a^2y_1) + y_1 \quad (2')$$
$$= mx + b^2/y_1$$
$$mx - y = -b^2/y_1$$

The equation (3) can be also rewritten into the following equation (3').

$$(1/m)x+y=ae/m \quad (3')$$

Co-ordinates (x, y) of the cross point q between the tangent T and perpendicular S is a point which satisfies both the equations (2') and (3'). Then, by solving the simultaneous equations (2') and (3'), the co-ordinates of the cross point Q (x, y) can be expressed as follows.

$$x = \frac{\begin{vmatrix} -b^2/y_1 & -1 \\ ae/m & 1 \end{vmatrix}}{\begin{vmatrix} m & -1 \\ 1/m & 1 \end{vmatrix}} = \frac{-b^2/y_1 + ae/m}{m + 1/m} \quad (4)$$

$$y = \frac{\begin{vmatrix} m & -b^2/y_1 \\ 1/m & ae/m \end{vmatrix}}{\begin{vmatrix} m & -1 \\ 1/m & 1 \end{vmatrix}} = \frac{ae - b^2/my_1}{m + 1/m} \quad (5)$$

From the equations (4) and (5) a sum of $x^2$ and $y^2$ is calculated as follows.

$$x^2 + y^2 = \frac{(-b^2/y_1 + ae/m)^2 + (ae - b^2/(my_1)^2)^2}{(m + 1/m)^2} = a^2 \quad (6)$$

From this equation (6) it can be understood that the co-ordinates (x,y) of the cross point q is on the auxiliary circle B having a center at the origin O of the X Y co-ordinates and a radius of a.

Figure 3A:
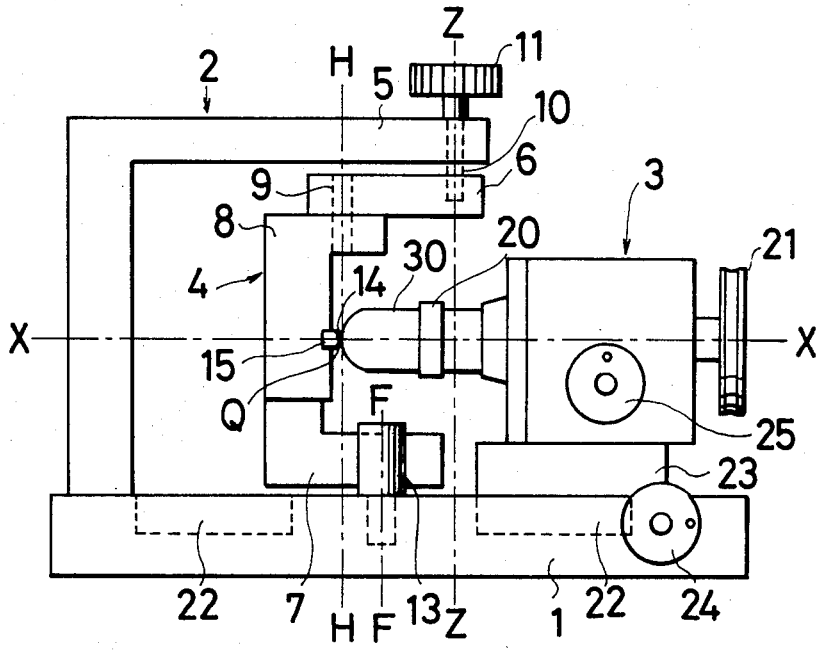
FIGS. 3*a*, 3*b* and 3*c* are side view, plan view and enlarged perspective view, respectively illustrating a modified cutting machine.
Figure 3B:
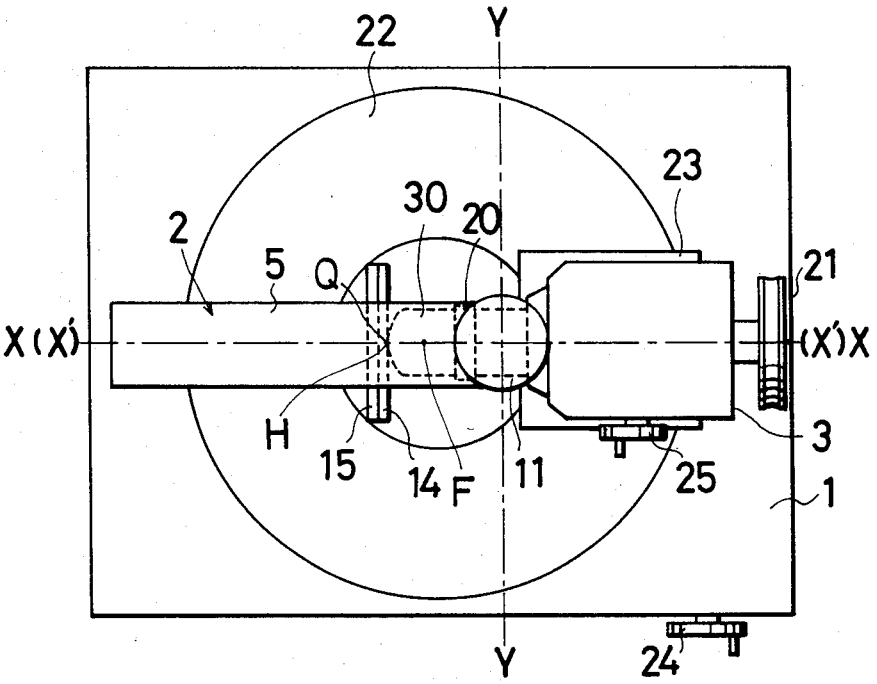
Figure 3C:
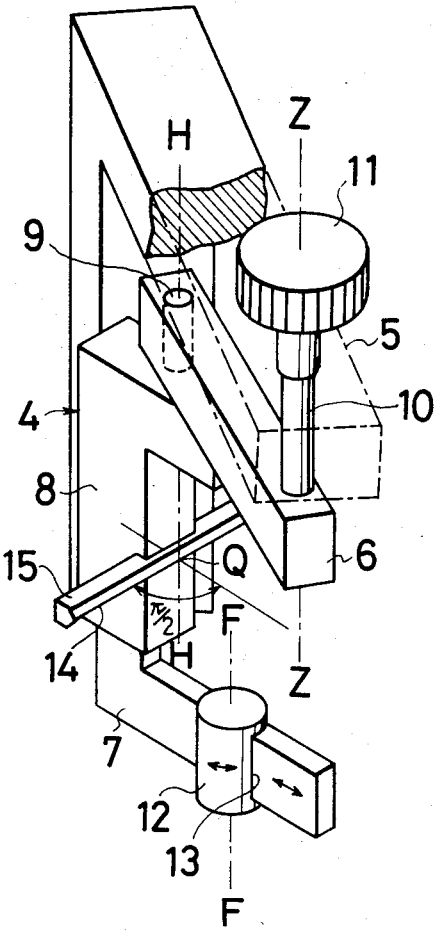
Figure 4:
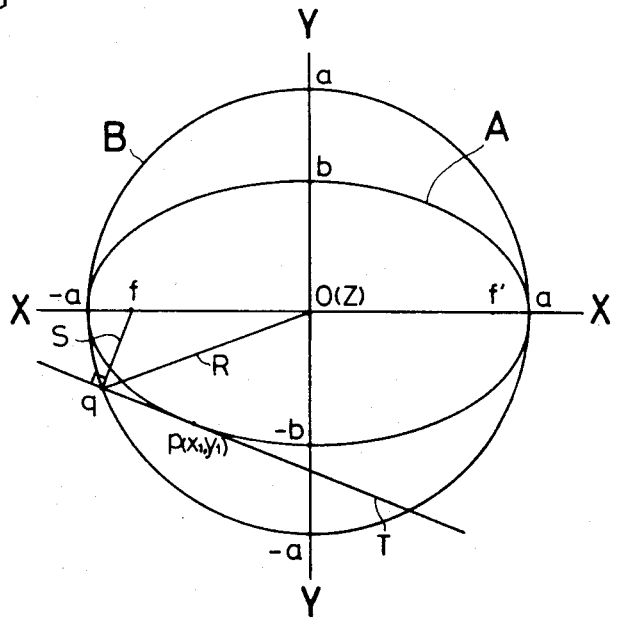
FIGS. 4 and 5 are diagrams for explaining the principle of forming an elliptical surface.

From the above analysis it can be made clear that in FIGS. 3*a*, 3*b* and 3*c*, the Z axis corresponds to the center O, the F—F axis (a center line of the focus shaft 12) to the focus f, the H—H axis and the point Q to the point q, the lower arm 7 of tool holding arm 4 to the perpendicular S extending from the focus f to the tangent T, and the upper arm 6 corresponds to a line R connecting the center O and the point q. Therefore, when the point q is moved along the auxiliary circle B, the tangent T moves continuously along the ellipse A and its envelope forms the ellipse A, while a distance f q in the perpendicular S changes continuously. When the workpiece 30 is rotated about the X axis (x' axis), its front end is cut by the working edge 14 into the ellipsoidal surface of revolution which corresponds to a convex surface of the ellipse A having a greater curvature, i.e. a convex surface of the ellipse A directing in the major axis. In case of adjusting the position of the tool holding frame 4 so as to make the working edge 14 in parallel with the Y axis, a distance in the X Y plane from the Z axis to the point Q on the working edge 14 corresponds to the major axis a and a distance from the Z axis to the F—F axis corresponds to a segment of in FIG. 4. As explained above, the position of the focus f is determined by a project of the major axis a and the ellipticity e and can be expressed by $\sqrt{a^2-b^2}$. Therefore, when the major axis a of the ellipse A and the position of the focus f are once determined, the minor axis b of the ellipse A can be naturally determined.

Figure 5:
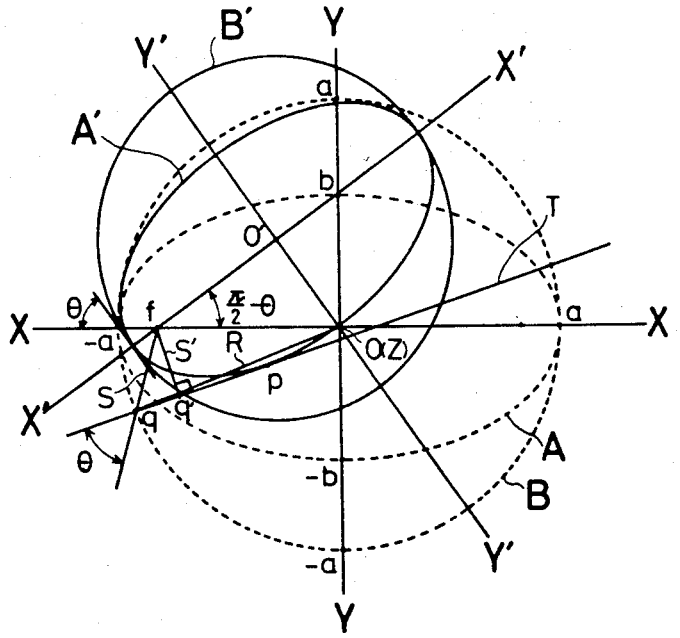

Next the apparatus shown in FIGS. 1*a*, 1*b* and 1*c* will be considered. In this apparatus, the direction of the working edge 14 of cutting tool 15 makes the angle $\theta$ with respect to the segment which connects horizontally the point Q and the F—F axis, and the X' axis passes through the F—F axis and is inclined by the angle $(\pi/2-\theta)$ with respect to the X axis in the X Y plane. It is easily considered that the working edge 14 inclined by the angle $\theta$ with respect to the longitudinal direction of the lower arm 7 will form an elliptical envelope. The X Y co-ordinates are transformed into the X'Y' co-ordinates in which the X' axis is obtained by rotating the X axis by the angle $(\pi/2-\theta)$ about the focus f and the Y' axis is obtained by rotating the Y axis by the angle $(\pi/2-\theta)$ about the origin O. As illustrated in FIG. 5, when the point q is moved along the auxiliary circle B having the origin O, a line T which passes through the point q and is inclined with respect to the line S by the angle $\theta$ becomes a tangent with respect to an ellipse A' of the X'Y' co-ordinates. This will be proved hereinbelow.

In FIG. 5, the circle B is an auxiliary circle having a radius which is equal to the major axis of the ellipse A having the major axis a and the minor axis b, and the point f is one of the foci of the ellipse A. Now the line S is drawn from the focus f to the point q on the auxiliary circle B and the line T is drawn in such a manner that it intersects with the line S with the angle $\theta$. When the point q moves on the circle B, the line T is always made a tangent with respect to the ellipse A' having the major axis of a sin $\theta$ in the direction of the X' axis rotated by $(\pi/2-\theta)$ with respect to the X axis and the minor axis of b sin $\theta$ in the direction of Y' axis passing through the origin O of the X Y co-ordinates. When a foot of the perpendicular S' extending from the focus f to the line T is denoted as q' and the point q moves along the circle B, triangles fqq' become similar ones, because it is always satisfied that an angle $fqq'=\theta$ and an angle $fq'q=\pi/2$. Therefore, a ratio of the segment fq to the segment fq' is always equal to sin $\theta$, i.e. $fq'/fq=\sin\theta$. Further, since the segment fq' makes the constant angle $(\pi/2-\theta)$ with respect to the segment fq, when the point q moves along the circle B, the point q' moves along the circle B' having the center at the origin O' of the X'Y' co-ordinates and the radius of a sin $\theta$. Moreover, since the perpendicular S' is made perpendicular to the line T, when the point q' moves along the circle B', the envelope of the moving line T becomes the ellipse A'. The ellipticity of this ellipse A' is equal to the ellipticity e of the ellipse A, but the major and minor axes are equal to the major and minor axes a and b, respectively of the ellipse A reduced by sin $\theta$.

Therefore, when the workpiece 30 is rotated about the X' axis, while the knob 11 is swung, the linear working edge 14 makes an envelope in the form of ellipse and thus, the front end of workpiece 30 is cut into the elipsoidal surface of revolution corresponding to the convex portion of the ellipse A' having the greater curveture, i.e. the convex portion directing in the major axis direction.

It should be noted that in FIG. 5, if the origin O' of the X'Y' co-ordinates is made coincident with the point f, the workpiece 30 may be cut into a spherical surface. Further, if the workpiece 30 is rotated about the Y' axis, the workpiece is cut into the ellipsoidal surface of revolution corresponding the concave portion of the ellipse A' having a smaller curvature, i.e. a concave portion directing in the minor axis.

Figure 6:
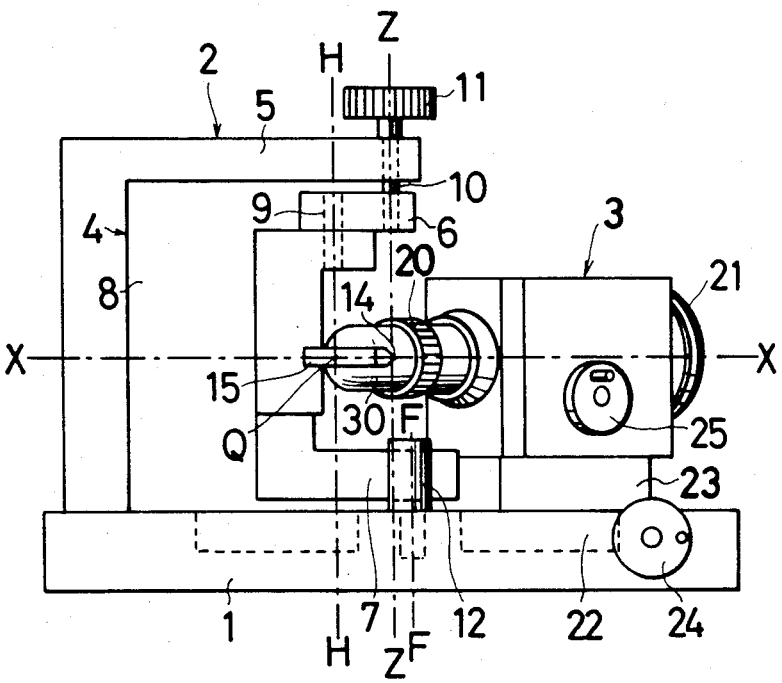
FIG. 6 is a side view depicting another embodiment of the cutting machine according to the invention for forming the elliptic surface.
Figure 7:
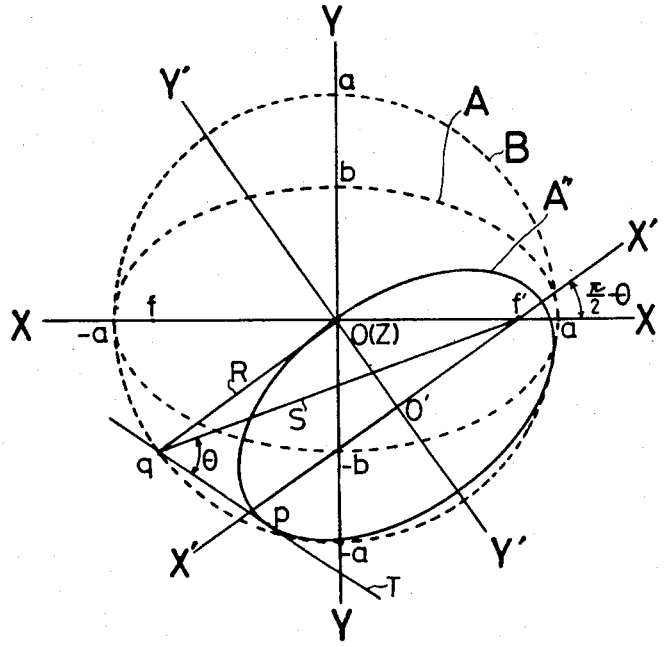
FIG. 7 is a diagram for explaing the operational principle of the machine shown in FIG. 6.

FIG. 6 shows another embodiment of the cutting machine according to the invention. In this embodiment the Z axis is interposed between the center point Q of the working edge 14 and the F—F axis. Then there is obtained an ellipse A'' having another focus f' passing through the F—F axis is shown in FIG. 7. Therefore, the workpiece 30 can be cut into an ellipsoidal surface of revolution corresponding to the ellipse A'' just like as explained hereinbefore.

Figure 8A:
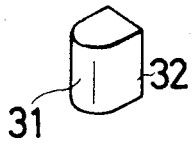
FIGS. 8*a* and 8*b* are perspective views showing elliptic cylinder and toric body with elliptic surface manufactured by the method according to the invention.
Figure 8B:
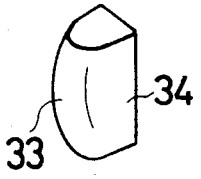

The cutting apparatuses shown in FIGS. 1, 2 and 6 are suitable for manufacturing a circular lens having quadric surface of revolution, i.e. an ellipsoidal surface of revolution. According to the invention, it is also possible to cut the workpiece into an elliptic cylinder such as a semicylindrical lens. For this purpose the workpiece is not rotated, but is moved in the direction of Z axis, while the cutting tool 15 is swung. Then, an elliptic cylinder 32 having its one surface cut into an elliptic surface 31 as illustrated in FIG. 8*a*. Alternatively, when the workpiece mounting member 3 is swung about an arbitrary point on the X' axis in a plane parallel to the X'Z plane without rotating the workpiece, it is possible to form a toric body 34 with double foci having an elliptic surface 33 as illustrated in FIG. 8*b*.

Figure 9:
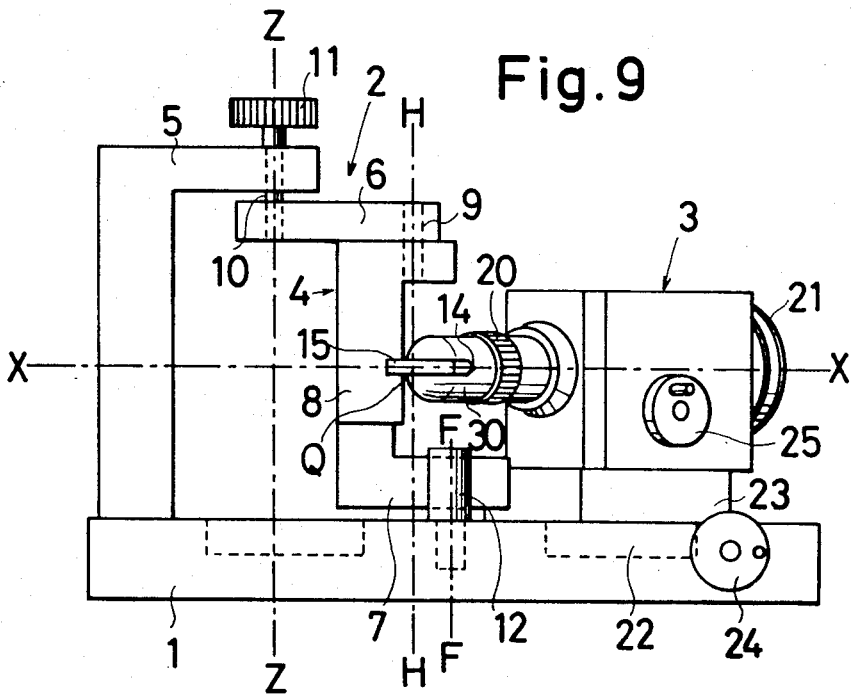
FIGS. 9 and 10 are side and enlarged perspective views, respectively illustrating another embodiment of the cutting machine according to the invention for forming a hyperbolic surface.
Figure 10:
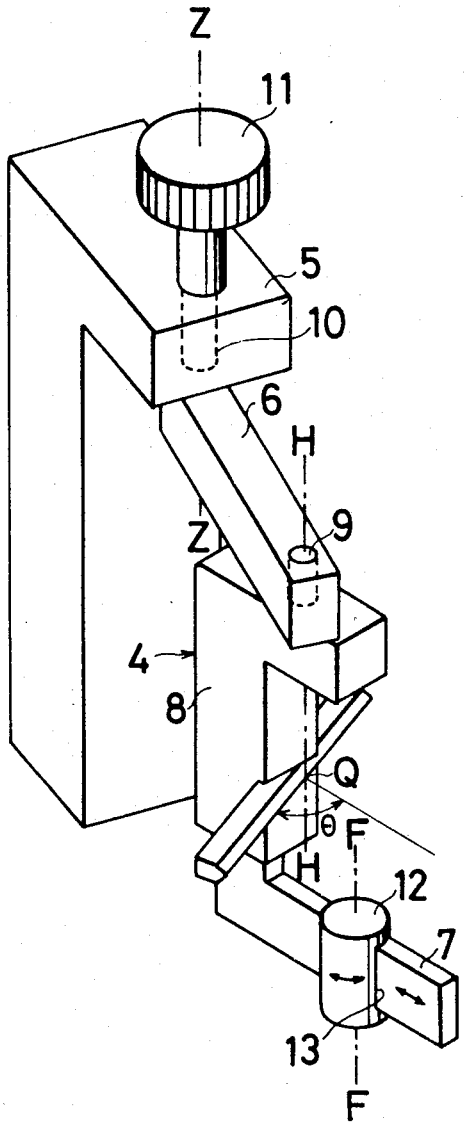

FIGS. 9 and 10 show still another embodiment of the cutting machine according to the invention for manufacturing a hyperboloid of revolution. This machine can be constructed by modifying partially the cutting machines previously explained with reference to FIGS. 1, 2 and 6. In the present embodiment, the upper arm 6 of tool holding arm 4 is turned by 180° about the connecting rod 9 and the operating arm 10 is removed into a position opposite to the workpiece 30 with respect to the working edge 14 of cutting tool 15. Therefore the Z axis is also removed into a center line of the shaft 10. Due to this shift of the Z axis, the F—F and H—H axes are located in a positive region of the X axis on the same side of the Z axis. i.e. When the tool holding arm 4 is moved by means of the knob 11, the shaft 10, the upper arm 6 and the connecting rod 9, while the workpiece 30 is rotated, the working edge 14 of cutting tool 15 moves as tangents to a hyperbola and thus, the front end of workpiece 30 is cut into a hyperboloid of revolution.

Figure 11:
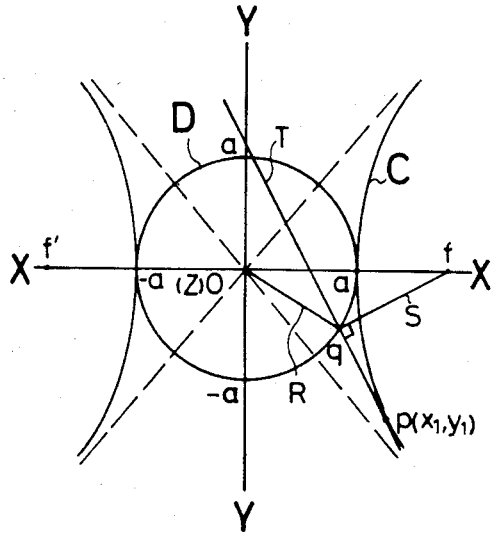
FIGS. 11 and 12 are diagrams for explaining the operational principle of the machine shown in FIGS. 9 and 10.

Next, the principle of this cutting operation will be explained with reference to FIGS. 11 and 12. As in the case of forming an ellipsoidal surface of revolution, it is considered at first that the direction of the working edge 14 is made perpendicular to the segment connecting the point Q on the edge 14 and the F—F axis, i.e. $\theta=\pi/2$ and the X' axis is made coincide with the X axis. As shown in FIG. 11, a cross point q between a tangent T at an arbitrary point p on a hyperbola C and a perpendicular S directing from a focus f to the tangent T falls always on an auxiliary circle D having a radius of a. This can be proved in the following manner.

The hyperbola C illustrated in FIG. 11 may be expressed by the following equation (7).

$$x^2/a^2-y^2/b^2=1 \tag{7}$$

In this equation a is the radius of the auxiliary circle D. The tangent T passing through an arbitrary point $p(x_1, y_1)$ on the hyperbola C may be written by the following equation (8)

$$y-y_1=m(x-x_1) \tag{8}$$

wherein, $m=b^2x_1/a^2Y_1$. The perpendicular S directing from the focus f to the tangent T is a line passing through the focus f (ae, O) and a gradient $-1/m$ and thus, can be represented as follows.

$$y=(-1/m)\,(x-ae) \tag{9}$$

The above equation (8) may be rewritten into the following equation (8')

$$y=mx-(b^2x_1)/(a^2y_1)+y_1=mx-b^2/y_1$$
$$mx-y=b^2/y_1 \tag{8'}$$

Then, the equation (9) may be also rewritten as follows.

$$(1/m)x+y=ae/m \tag{9'}$$

Therefore, by solving the simultaneous equations (8') and (9'), co-ordinates (x,y) of the cross point q between the tangent T and the perpendicular S can be derived in the following manner.

$$x=\frac{\begin{vmatrix} b^2/y_1 & -1 \\ ae/m & 1 \end{vmatrix}}{\begin{vmatrix} m & -1 \\ 1/m & 1 \end{vmatrix}}=\frac{b^2/y_1+ae/m}{m+1/m} \tag{10}$$

$$y=\frac{\begin{vmatrix} m & b^2/y_1 \\ 1/m & ae/m \end{vmatrix}}{\begin{vmatrix} m & -1 \\ 1/m & 1 \end{vmatrix}}=\frac{(ae-b^2/my_1)}{m+1/m} \tag{11}$$

Now, a sum of $x^2$ and $y^2$ may be obtained as follows.

$$x^2+y^2=\frac{(b^2/y_1+ae/m)^2+(ae-b^2/my_1)^2}{(m+1/m)^2}=a^2 \tag{12}$$

This equation (12) represents that the point q is located on the auxiliary circle D having the center O and the radius of a. It should be noted that the position of the focus f may be expressed as ae, wherein e is an eccentricity of hyperbola.

In this manner, by positioning the operating shaft 10 at a center of the auxiliary circle D, i.e. the origin of the co-ordinates, moving the tool holding arm 4 with being supported at the Z axis and the F—F axis, the H—H axis corresponding to the point q in FIG. 11 and thus the point Q on the working edge 14 move along the auxiliary circle D. Since the working edge 14 forms the tangent T in FIG. 11, its envelope draws the hyperbola C. Therefore, the workpiece 30 may be cut into the hyperboloid of revolution with a center axis extending in the X axis (X' axis).

Next, the apparatus shown in FIGS. 9 and 10 will be considered. In this apparatus the direction of the working edge 14 of cutting tool 15 makes the angle $\theta$ with respect to the segment which connects the point Q on the edge 14 and the F—F axis, and the X' axis passes through the F—F axis and is inclined by the angle $(\pi/2-\theta)$ on the XY plane with respect to the X axis. As shown in FIG. 12, when the point q is moved along the auxiliary circle D with the center corresponding to the origin O of the XY co-ordinates, a line T passing through the point q and being inclined by the angle $\theta$ with respect to the line S is made in contact with a hyperbola C' at the point p. Like the ellipse, this hyperbola C' may be expressed by the co-ordinates X', Y' having the origin O' and the auxiliary circle D' has a radius of a sin $\theta$. An eccentricity of the hyperbola C' is equal to that of the hyperbola C. This will be proved hereinbelow.

Figure 12:
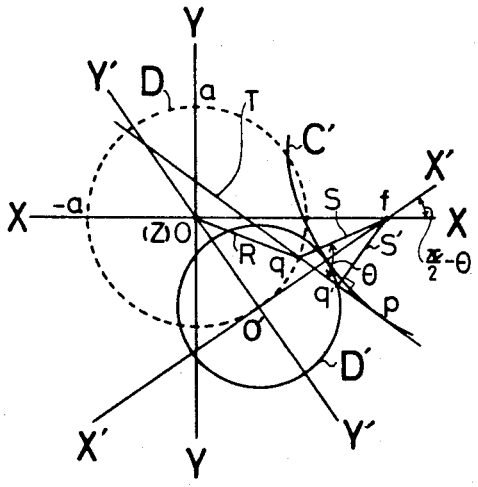

In FIG. 12, when a foot of a perpendicular S' extending from the focus f to the line T is denoted as q', it is always satisfied that an angle $fqq'=\theta$ and an angle $fq'q=\pi/2$. Therefore, when the point q moves along the circle D, triangles fqq' become similar. A ratio of the segments fq and fq' is always equal to sin $\theta$, i.e. $fq'=\sin\theta$. Further, since the segment fq' makes the constant angle $(\pi/2-\theta)$ with respect to the segment fq and the ratio of these segments is kept to the constant value of sin $\theta$, when the point q moves along the circle D with the radius of a, the point q' moves along the circle D' with the radius of a sin $\theta$. The circle D' has its center at the origin O' of the X'Y' co-ordinates with the X' axis which is obtained by rotating the X axis about the focus f by the angle $(\pi/2-\theta)$ and the Y' axis which is obtained by rotating the Y axis about the origin O by the same angle $(\pi/2-\theta)$. Therefore, the point q' moves along the circle D' with the movement of the point q along the circle D' and the line T is made perpendicular to the line S' and is made in contact with the hyperbola C' shown in FIG. 12.

When the workpiece 30 is rotated about the X' axis, while the knob 11 is swung, the linear working edge 14 makes an envelope in the form of the hyperbola C' and thus the front end of workpiece 30 is cut into the hyperbolic surface of revolution.

When the workpiece 30 is linearly moved in the Z axis without being rotated, a hyperbolic cylinder may be obtained. Further when the workpiece 30 is swung about a point on the X' axis in the X'Z plane, the workpiece may be cut into a toric body with a hyperbolic surface.

Figure 13:
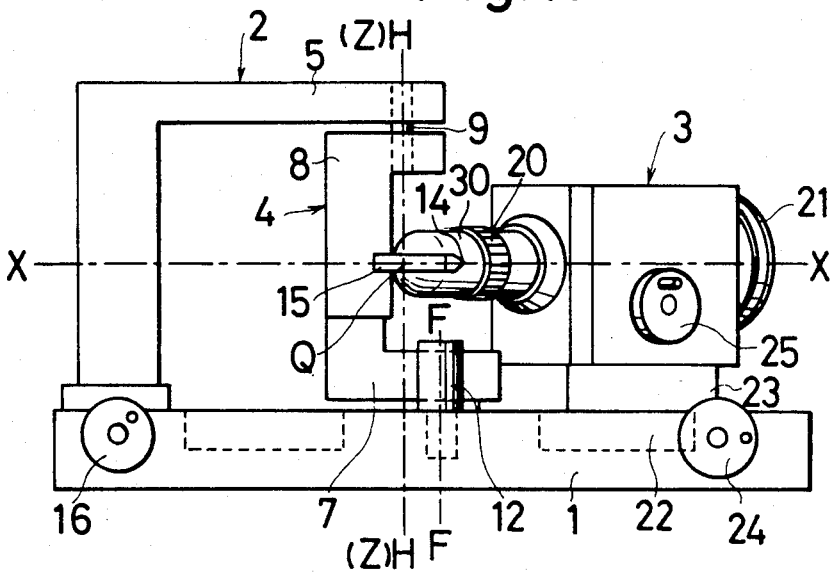
FIGS. 13 and 14 are side and enlarged perspective views, respectively showing still another embodiment of the cutting machine according to the invention for forming a parabolic surface.
Figure 14:
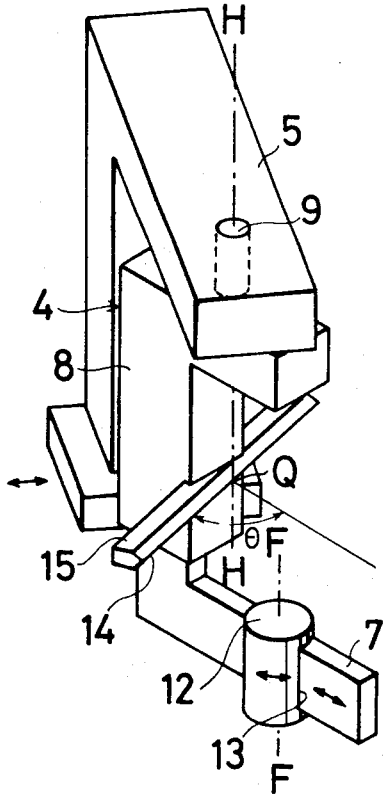

FIGS. 13 and 14 illustrate still another embodiment of the cutting machine according to the invention for forming a paraboloid of revolution. This cutting machine may be constructed by slightly modifying the previous machines shown in FIGS. 1, 2, 6 and 9 in the following manner. The tool supporting frame 5 is made slidable in the direction of Y axis with respect to the bed 1 by means of a handle 16 and thus, the point Q on the working edge 14 of cutting tool 15 can be moved linearly along the Y axis, Further the upper arm 6 of the machine shown in FIGS. 1, 6 and 9 is removed and the connecting rod 9 is directly journalled to the tool supporting frame 5. It is further defined that the Z axis is coincided with the H—H axis of the center line of the connecting rod 9 intersecting with the X axis. The remaining construction of the present cutting machine is entirely same as that of the previous cutting machines. When the workpiece 30 is moved toward the working edge 14 of cutting tool 15 by rotating the handle 25, while the handle 16 is rotated to move the tool supporting frame 5 in the direction of Y axis (direction perpendicular to the drawing of FIG. 13), the upper arm 7 is rotated about the focus shaft 12 and is at the same time slid through the shaft 12. Then the working edge 14 forms tangents having an envelope of the parabolic surface and the rotating workpiece 30 is cut into the paraboloid of revolution.

Figure 15:
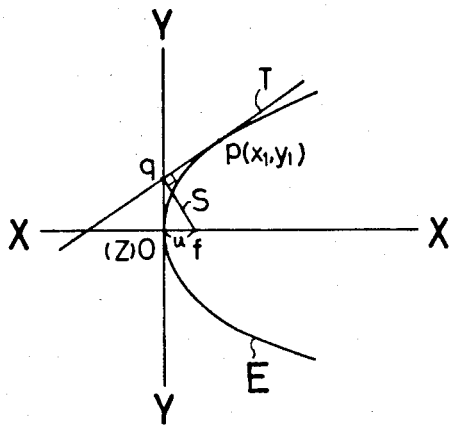
FIGS. 15 and 16 are diagrams for explaining the operating principle of the machine illustrated in FIGS. 13 and 14.
Figure 16:
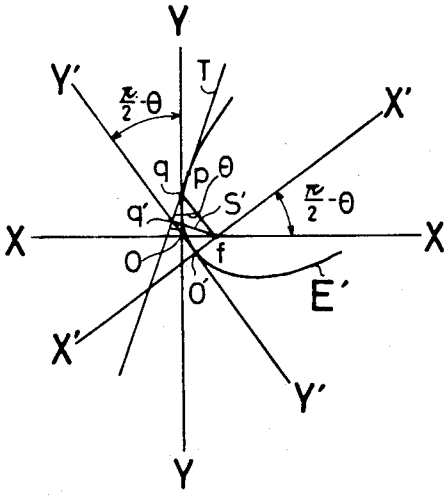

Now the principle of this cutting will be explained in detail with reference to FIGS. 15 and 16. At first a simplified apparatus is considered in which the direction of the working edge 14 makes right angles with respect to a segment connecting horizontally the point Q and the F—F axis, i.e. $\theta=\pi/2$ and the X' axis is made coincident with the X axis. In FIG. 15, a cross point q between a tangent T at an arbitrary point p on a parabola E and a perpendicular S directing from a focus f to the tangent T falls always on the Y axis. This will be proved as follows.

The parabola E shown in FIG. 15 may be expressed by the following equation (13)

$$y^2=4ux \tag{13}$$

wherein, u is a distance from the origin O to the focus f. Then a tangent T at an arbitrary point p ($x_1$, $y_1$) on the parabola E may be expressed as follows.

$$y-y_1=(2u/y_1)(x-x_1) \tag{14}$$

The perpendicular S directing from the focus (u, o) to the tangent T may be represented by the following equation (15).

$$y=-(y_1/2u)(x-u) \tag{15}$$

By solving the simultaneous equations (14) and (15), co-ordinates of the cross point q (x, Y) may be obtained in the following manner. Af first the equations (14) and (15) may be rewritten as follows.

$$(2u/y_1)x-y=(2u/y_1)x_1-y_1=-2ux_1/y_1 \tag{14'}$$

$$(y_1/2u)x+y=y_1/2 \tag{15'}$$

Then, $$x=\frac{\begin{vmatrix}-2ux_1/y_1 & -1\\ y_1/2 & 1\end{vmatrix}}{\begin{vmatrix}2u/y_1 & -1\\ y_1/2u & 1\end{vmatrix}}=\frac{-(4ux_1-y_1^2)/2y_1}{2u/y_1+y_1/2u}=0 \tag{16}$$

-continued $$y = \frac{\begin{vmatrix} 2u/y_1 & -2ux_1/y_1 \\ y_1/2u & y_1/2 \end{vmatrix}}{\begin{vmatrix} 2u/y_1 & -1 \\ y_1/2u & 1 \end{vmatrix}} = y_1/2 \quad (17)$$

From the equation (16), it is apparent that the point q is located on the Y axis.

In this manner, by moving the cross point q between the tangent T and the perpendicular S along the Y axis, the tangent T is made always in contact with the parabola E. Also in this embodiment, the F—F axis in FIGS. 13 and 14 corresponds to the focus f in FIG. 15 and the H—H axis and the point Q on the working edge 14 correspond to the point q in FIG. 15. Therefore, the linear working edge 14 forms the envelope of the tangent T with respect to the parabola E and thus, the workpiece 30 can be cut into the paraboloid of revolution.

Next, the cutting machine shown in FIGS. 13 and 14 will be explained. In this apparatus, the direction of the working edge 14 makes the angle $\theta$ with respect to the segment connecting the point Q and F—F axis and the X' axis passes through the F—F axis and is inclined by the angle of $(\pi/2-\theta)$ with respect to the X axis in the XY plane. As illustrated in FIG. 16, when the point Q is moved along the Y axis, the line T passing through the point q and being inclined by the angle $\theta$ with respect to the line S is made in contact with a parabola E' at the point p. As with the ellipse and hyperbola, the parabola E' may be expressed by the transferred co-ordinates X', Y' having the origin O' and a distance from the origin 0' to the focus f is equal to u sin $\theta$. This will be proved hereinafter.

As shown in FIG. 12, when a foot of a perpendicular S' extending from the focus f to the line T is referred as q', it is always satisfied that an angle $fqq'=\theta$ and an angle $fq'q=\pi/2$. Therefore triangles fqq' are similar ones as long as the point q lies on the Y axis and a ratio of the segment fq to the segment fq(fq/f'q') is always equal to sin $\theta$. Further, since the segment fq' is shifted by the constant angle $(\pi/2-\theta)$ with respect to the segment fq and the ratio of these segments is kept constant, when the point q moves along the Y axis, the point q' is moved along the Y' axis which is rotated by the angle of $(\pi/2-\theta)$ with respect to the Y axis. The Y' axis intersects perpendicularly at the origin O' with the X' axis which passes through the focus f and is inclined by the angle $(\pi/2-\theta)$ with respect to the X axis. Therefore, when the line T is viewed by means of the X'Y' co-ordinates, the foot q' of the perpendicular S' directing from the focus f to the line T is always situated on the Y' axis. Therefore, the line T is always made in contact with the parabola E' as proved above with reference to FIG. 15.

When the workpiece 30 is rotated about the X' axis while the H—H axis is moved along the Y axis by rotating the handle 16, the workpiece 30 is cut into the paraboloid of revolution.

It should be noted that a parabolic cylinder and a toric body with a paraboloid of revolution may be formed in a similar manner as that for forming the elliptical cylinder or toric body with the ellipsoidal surface.

Figure 17A:
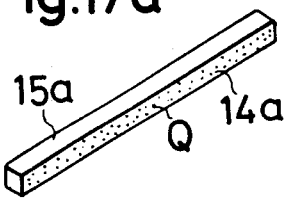
FIGS. 17*a*, 17*b* and 17*c* are perspective views showing other embodiments of the cutting tool.
Figure 17B:
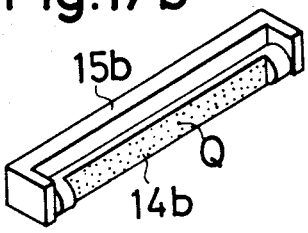
Figure 17C:
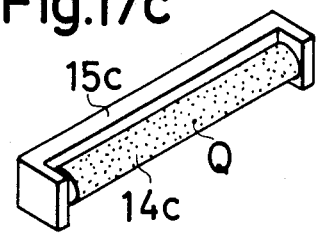

As explained above in detail, by the method according to the invention, the workpiece 30 is cut by the linear working edge 14 into ideal quadrics. The present invention is not limited to the embodiments explained above, but may be modified in various manners. For instance, the cutting tool 15 is not necessary to have the sharp knife-edge as in the above embodiments, but may be formed as a grinding tool 15*a* having a planar grinding surface 14*a* as illustrated in FIG. 17*a*. Further, in a grinding tool 15*b* shown in FIG. 17*b*, a planar grinding surface 14*b* is rotatably arranged. Alternatively, a grinding tool 15*c* shown in FIG. 17*c* comprises a rotatable grinding rod 14*c* having a circular cross section. When the workpiece 30 is made of relatively soft material such as synthetic resin, the grinding or cutting tool may be formed of usual high speed steel, but when the workpiece is made of relatively hard material such as glass, the tool 15 may be preferably formed of a super hard tool including diamond grains or tungsten carbides. The given quadric surface cut by the tool 15 would be substantially smooth. But it is preferable to subject the ground surface to polishing treatment. For this purpose, the grinding or cutting tool 15 may be simply replaced by a polishing tool having a linear polishing surface.

As explained above, in the method according to the invention the workpiece can be ground or cut directly into a lens or a mirror having a quadric convex surface. It is also possible to cut or grind a body of grinding material to form a grinding tool having a given quadric surface and then lenses or mirrors having the corresponding quadric surfaces may be formed, while said grinding tool is used as a secondary working tool.

Figure 18A:
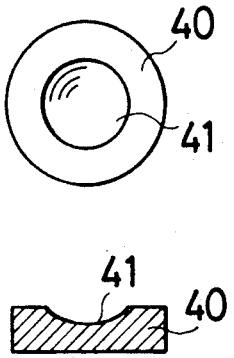
FIGS. 18*a* and 18*b* are plan and cross sectional views, respectively showing master molds formed by pressing.
Figure 18B:
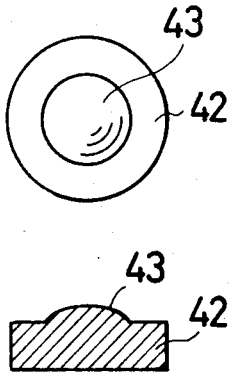

In an alternative method for manufacturing the quadric surfaces, a master mold 40 made of suitable material is formed by pressing the workpiece 30 having the quadric surface formed by any one of the above mentioned methods as shown in FIG. 18*a*. The master mold 40 has a given quadric surface 41. When a copy-grinding is effected in accordance with the quadric surface 41 of the master mold 40, a concave quadric surface may be obtained, whilst when the master mold 40 is used to conduct a press-molding, a convex quadric surface may be formed. Further, another master mold 42 having a convex quadric surface 43 shown in FIG. 18*b* may be formed by pressing the master mold 40 and then the master mold 42 may be used to effect copy-grinding or press-molding to form convex or concave quadratic surface.

Figure 19:
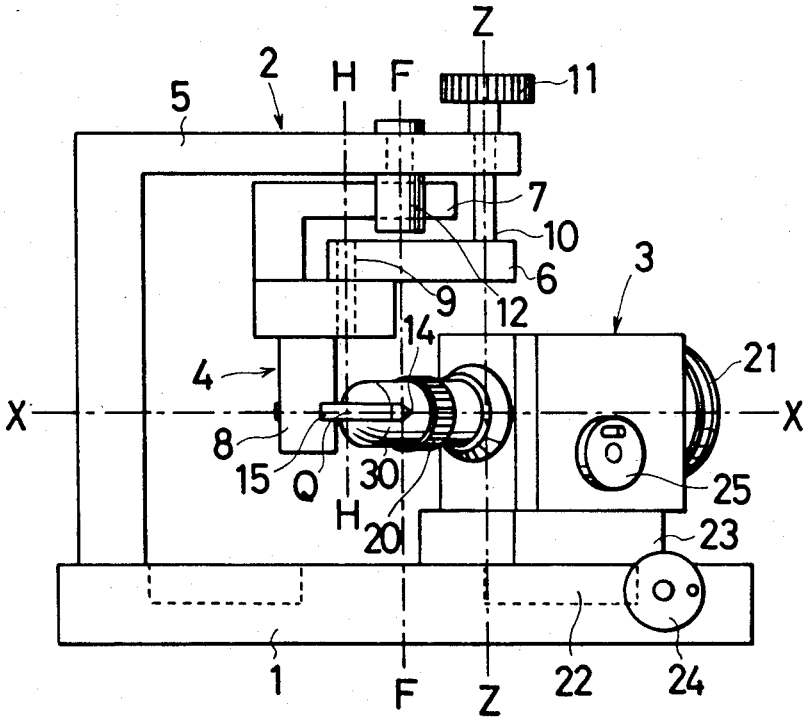
FIG. 19 is a side view depicting still another embodiment of the cutting machine according to the invention for forming an elliptic surface.

In the above explanation, use is made of the X, Y and Z quadratic coordinates for the sake of simplicity, it is not necessary to arrange the XY plane horizontally and the Z axis vertically. In case of manufacturing lenses having large diameters, it is preferable to arrange vertically the X' axis passing through the center line of workpiece 30. Further, in the above embodiments the tool holding arm 4 is supported by the focus shaft 12 on the bed 1 and the operating shaft 10 or the connecting rod is journalled to the tool supporting frame 5, but they may be arranged upside down. Further, the cutting machine shown in FIGS. 1 and 2 may be modified as illustrated in FIG. 19, in which the focus axis 12 is journalled to the tool supporting frame 5 and the cutting tool 15 is hung from the arms 6 and 7. Alternatively, the tool supporting frame 5 may be removed, the operating shaft 10 is journalled to the bed 1 and the working tool 15 may be protruded upwards. In the above embodiments the diameter of the auxiliary circle, the distance between the Z and F—F axes, the distance between the Z and H—H axes and the angle $\theta$ of the cutting tool 15 are considered to be fixed, but these values may be changed at will. Further by suitable designing the tool supporting frame 5 and the tool holding arm 4, the elliptic, parabolic and hyperbolic surfaces may be formed by a single cutting machine. In such a cutting machine, the position of the Z axis is apparently changed in accordance with a quadric surface to be formed. It should be noted that the mechanism for supporting rotatably the focus shaft 12 as well as for supporting slidably the lower arm 7 of tool holding arm 4, the mechanism for tilting the X' axis, and the mechanism for operating the tool holding arm 4 may be constructed by any suitable mechanisms other than those illustrated in the drawings. Instead of tilting the workpiece mounting member 3, the tool mounting member 2 may be moved to make the angle of $(\pi/2-\theta)$ with respect to the fixed workpiece mounting member 3. Further the tool mounting member 2 may be moved toward the fixed workpiece mounting member 3. This movement may be advantageously effected in an automatic manner. In order to form the quadric surfaces of revolution, the cutting tool 15 and the workpiece 30 should be rotated about the X' axis relative to each other. For this purpose, the working tool 15 and thus the tool mounting member 2 may be rotated about the X' axis with respect to the fixed workpiece 30. In the above embidiments, the tool holding arm 4 is moved manually by means of the knob 11 and the handle 16, but in case of the workpieces made of hard meterial, this may be preferably effected by electric motors. Further, the working tool may be formed by a rotating disc-shaped grinder. Moreover, in the embodiment shown in FIG. 19, the shaft 10 may be deleted and the H—H axis may be moved circularly along a slit or recess.

As explained above in detail, in the method according to the invention the workpiece can be cut and/or ground accurately into the theoretical quadric surfaces, because the linear working edge forms the corresponding quadric surfaces. Further by changing the tilting angle $\theta$ of the working tool, the dimension of the quadric surfaces may be simply adjusted, while the eccentricity is maintained unchanged. For instance, by utilizing the optical lenses manufactured by the method according to the invention, lens systems substantially free from aberrations can be easily realized and thus, the systems become smaller in size and lighter in weight than known lens systems composed of a plurality of spherical lenses in order to eliminate or decrease aberrations.

What is claimed is:

1. A method for manufacturing a quadric surface on a workpiece comprising:

providing a bed for supporting an apparatus for manufacturing said quadric surface, said bed being parallel to an X-Y plane;

securing a working tool having a linear working edge to a tool mounting assembly which comprises a supporting frame mounted on said bed, a tool holding member having a substantially U-shaped side-elevational configuration including an upper arm and a lower arm connected to said upper arm by a middle tool carrying portion, the upper arm being journalled to the supporting frame so as to be rotatable with respect to said frame and being pivotably connected to said middle tool carrying portion by a connecting rod so that said upper arm is pivotable relative to said middle portion, and the lower arm being journalled to said bed by a focus shaft whereby said tool holding member is rotatable about said focus shaft extending in an XZ plane passing through an origin of rectangular coordinates of X, Y and Z axes and being in parallel with the Z axis, said lower arm being slidably connected to said focus shaft so as to be slidable linearly in parallel with the XY plane, and said connecting rod having an axis which is parallel to the Z axis said working tool being arranged in such a manner that its working edge is faced against an axial line of said focus shaft and lies in the XY plane and that a longitudinal direction of the working edge makes an angle $\theta$ with respect to a line which is obtained by projecting a sliding direction of said tool holding arm onto the XY plane; moving a cross point between the working edge and said projected line along a circle having a center at the origin of the XY coordinates;

securing a workpiece to be shaped to a workpiece mounting member, slidably and rotatably mounted on said bed in such a manner that a center axis of the workpiece lies in an X'Z plane formed by the Z axis and an X' axis which is obtained by rotating the X axis by an angle $(\pi/2-\theta)$ about the focus shaft; and moving the working tool and the workpiece relative to each other to form the workpiece into a quadric surface in accordance with the quadric surface formed by said working edge as an envelope of tangents.

2. A method according to claim 1, wherein said focus shaft and the Z axis are situated on the same side of the working edge so as to form an elliptic surface.

3. A method according to claim 2, wherein said workpiece and working edge are rotated relative to each other about the X' axis so as to form an ellipsoidal surface of revolution.

4. A method according to claim 2, wherein said workpiece and working edge are moved relative to each other in parallel with the Z axis so as to form an elliptic cylinder.

5. A method according to claim 2, wherein the workpiece and working edge are rotated relative to each other about a point on the X' axis so as to form a toric body with an ellipsoidal surface of revolution.

6. A method according to claim 1, wherein said focus shaft and the Z axis are situated on respective sides of the working edge so as to form a hyperbolic surface.

7. A method according to claim 6, wherein said workpiece and working edge are rotated relative to each other about the X' axis so as to form a hyperboloid of revolution.

8. A method according to claim 6, wherein said workpiece and working edge are moved relative to each other in parallel with Z axis so as to form a hyperbolic cylinder.

9. A method according to claim 6, wherein said workpiece and working edge are rotated relative to each other about a point on the X' axis so as to form a toric body with a hyperboloid of revolution.

10. A method according to claim 1, wherein said cross point between the working edge and the projected line is moved along the Y axis and said focus shaft is situated on that side of the Z axis which faces the working edge so as to form a parabolic surface.

11. A method according to claim 1, wherein said workpiece and working edge are rotated relative to each other about the X' axis so as to form a paraboloid of revolution.

12. A method according to claim 10, wherein said workpiece and working edge are moved relative to each other in parallel with the Z axis so as to form a parabolic cylinder.

13. A method according to claim 10, wherein said workpiece and working edge are rotated relative to each other about a point on the X′ axis so as to form a toric body with paraboloid of revolution.

14. A method according to claim 1, wherein a master mold is formed by transferring the workpiece having the surface formed in the quadric configuration and the master mold thus formed is used to form another workpiece into a corresponding quadric surface by copy-grinding.

15. A method according to claim 1, wherein a master mold is formed by transferring the workpiece having the surface formed in the quadric configuration and the master mold thus formed is used to form another workpiece into a corresponding quadric surface by press-molding.

* * * * *